US010201995B2

(12) United States Patent
Matsuda

(10) Patent No.: US 10,201,995 B2
(45) Date of Patent: Feb. 12, 2019

(54) PRINTER AND METHOD FOR SELECTING PRINTING START POSITION

(71) Applicant: TOSHIBA TEC KABUSHIKI KAISHA, Shinagawa-ku, Tokyo (JP)

(72) Inventor: Okiharu Matsuda, Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/874,966

(22) Filed: Jan. 19, 2018

(65) Prior Publication Data

US 2018/0141360 A1 May 24, 2018

Related U.S. Application Data

(63) Continuation of application No. 15/460,511, filed on Mar. 16, 2017, now Pat. No. 9,908,354.

(30) Foreign Application Priority Data

Jul. 20, 2016 (JP) ..... 2016-142577

(51) Int. Cl.

| | |
|---|---|
| ***B41J 29/393*** | (2006.01) |
| ***B41J 2/32*** | (2006.01) |
| ***B41J 13/00*** | (2006.01) |
| ***B41J 3/407*** | (2006.01) |
| ***B41J 11/00*** | (2006.01) |
| ***B41J 11/42*** | (2006.01) |
| ***B41J 15/00*** | (2006.01) |

(52) U.S. Cl.

CPC ..... *B41J 29/393* (2013.01); *B41J 2/32* (2013.01); *B41J 3/4075* (2013.01); *B41J 11/0095* (2013.01); *B41J 11/42* (2013.01); *B41J 11/425* (2013.01); *B41J 13/0009* (2013.01); *B41J 15/00* (2013.01)

(58) Field of Classification Search

CPC ..... B41J 2/32; B41J 3/4075; B41J 11/0095; B41J 11/42; B41J 11/425; B41J 15/00

See application file for complete search history.

(56) References Cited

U.S. PATENT DOCUMENTS

2010/0032466 A1 2/2010 Nishimura et al.
2016/0119486 A1 4/2016 Matsuda

*Primary Examiner* — Julian D Huffman

(74) *Attorney, Agent, or Firm* — Amin, Turocy & Watson LLP

(57) ABSTRACT

In accordance with an embedment, a printer comprises a sensor configured to detect a position of a paper conveyed in a conveyance path; a first setting module configured to set a plurality of start candidate positions which are candidates of a printing start position in a paper conveyance direction based on a sensing result of the sensor; a test printing module configured to carry out a test printing for specifying the start candidate position on the paper for each start candidate position set by the first setting module; a reception module configured to receive selection of one start candidate position from the start candidate positions specified by the test printing; and a second setting module configured to set the start candidate position received by the reception module as the printing start position.

8 Claims, 10 Drawing Sheets

FIG.10

PLEASE SELECT PRINTING START POSITION.

(1)~(5)

※PLEASE OPERATE "N" IF MANUALLY
CARRYING OUT ADJUSTMENT.

PRINTER AND METHOD FOR SELECTING PRINTING START POSITION

CROSS-REFERENCE TO RELATED APPLICATIONS

This application is a Continuation of application Ser. No. 15/460,511 filed on Mar. 16, 2017, the entire contents of which are incorporated herein by reference.

This application is based upon and claims the benefit of priority from Japanese Patent Application No. P2016-142577, filed Jul. 20, 2016, the entire contents of which are incorporated herein by reference.

FIELD

Embodiments described herein relate generally to a printer and a method for selecting a printing start position.

BACKGROUND

Conventionally, in a printer, a position of a paper conveyed in a conveyance path is detected by using a sensor such as a transmission type sensor or a reflection type sensor. The sensor detects a paper portion where the paper (label) which is a printed object is present and a non-paper portion according to a quantity of light. The printer determines a start position of printing (printing start position) in a conveyance direction of the paper based on a sensing result (output signal) of the sensor.

A conventional printer is equipped with a function capable of manually correcting the printing start position. With the function, a user measures the printing start position in an exact size from an actual printing result and can carry out adjustment in such a manner that the printing start position becomes a proper position by inputting a correction value corresponding to a length of a deviation if the deviation occurs.

However, since it is necessary to measure the printing start position in the exact size, the above-described adjustment method is complicated, and there is a problem that time is required as an operation of inputting the correction value, and checking the printing result is undesirably repeated in some cases.

DESCRIPTION OF THE DRAWINGS

FIG. 10 is a diagram illustrating another example of the selection screen displayed on the user interface section according to the embodiment.

DETAILED DESCRIPTION

In accordance with an embedment, a printer comprises a sensor, a first setting module, a test printing module, a reception module and a second setting module. The sensor detects a position of a paper conveyed in a conveyance path. The first setting module sets a plurality of start candidate positions which are candidates of a printing start position in a paper conveyance direction based on a sensing result of the sensor. The test printing module carries out a test printing for specifying the start candidate position on the paper for each start candidate position set by the first setting module. The reception module receives selection of one start candidate position from the start candidate positions specified by the test printing. The second setting module sets the start candidate position received by the reception module as the printing start position.

Hereinafter, an embodiment of a printer and a method for setting a printing start position according to the present invention is described in detail with reference to the accompanying drawings. The embodiment described later is described as an example of applying the present invention to a label printer; however, the present invention is not limited to the embodiment.

Figure 1:
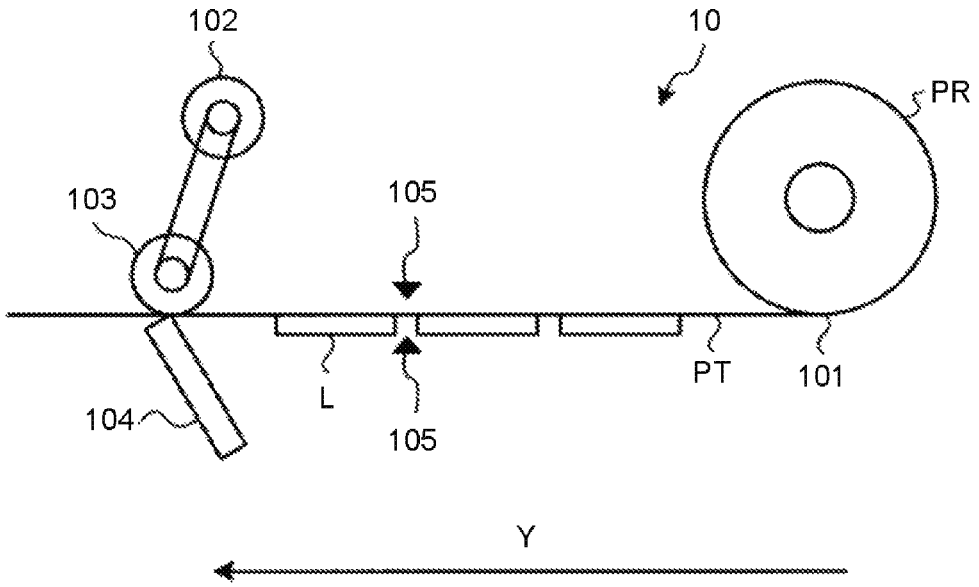
FIG. 1 is a diagram schematically illustrating schematic constitution of a printer according to an embodiment.

FIG. 1 is a diagram schematically illustrating schematic constitution of a printer 10 according to an embodiment. As shown in FIG. 1, the printer 10 includes a paper storage section 101, a stepping motor 102, a platen roller 103, a thermal head 104 and a transmission type sensor 105.

The paper storage section 101 houses a paper roller PR in a freely detachable manner. The paper roller PR is formed by winding a label paper PT into a roll shape. The label paper PT is formed by attaching a label L which is a freely peelable thermal paper to a belt-like paper (mount) at predetermined intervals. The paper roller PR is housed in the paper storage section 101 in a state in which a roll axis thereof faces a width direction of the printer 10.

The stepping motor 102 is a drive source for rotating the platen roller 103. If the stepping motor 102 is driven under the control of a motor driver 118 (refer to FIG. 2) described later, the platen roller 103 is driven to rotate via a gear. By the rotation of the platen roller 103, the paper roller PR is drawn from the paper storage section 101 as the label paper PT to be conveyed in a paper conveyance direction Y.

The thermal head 104 is arranged to face the platen roller 103. The thermal head 104 is constituted by arranging heat generating elements with plural predetermined densities in a row. The thermal head 104 enables the heat generating elements to generate heat under the control of a head driver 117 (refer to FIG. 2) described later to heat the label paper PT conveyed in a paper conveyance path to print characters or figures. The label paper PT (label L) to which the printing is carried out is discharged to a paper discharge port (not shown).

The transmission type sensor 105 corresponds to a sensor of the present embodiment. The transmission type sensor 105 is arranged in the paper conveyance path for connecting the paper storage section 101 with the thermal head 104. The transmission type sensor 105 is constituted by a pair of a light emitting element and a light receiving element. The transmission type sensor 105 detects the positions of the label L and a gap part described later by detecting a quantity of light penetrating the label paper PT.

Figure 2:
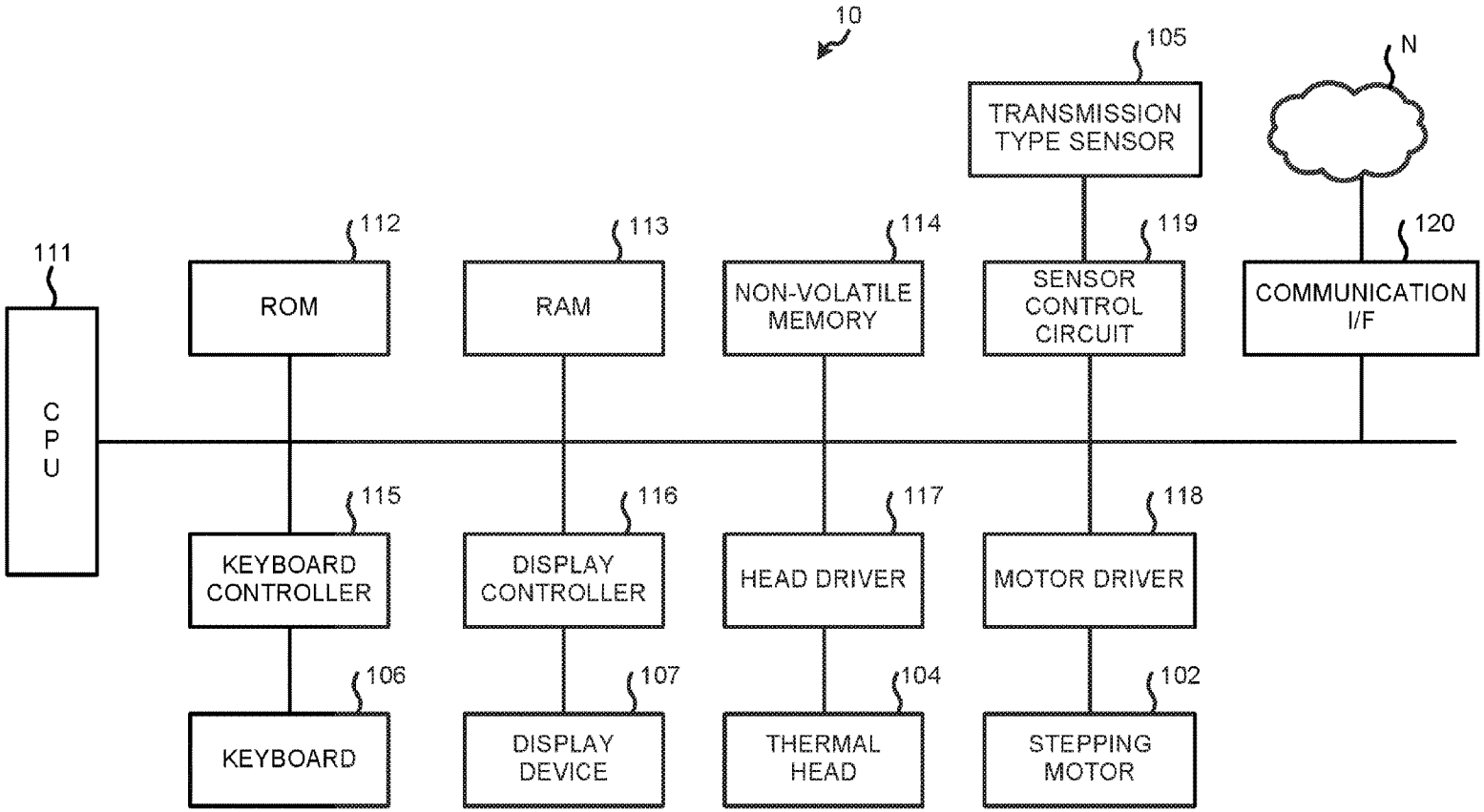
FIG. 2 is a diagram illustrating an example of a control system of the printer according to the embodiment.

A control system of the printer 10 is described with reference to FIG. 2. FIG. 2 is a diagram illustrating an example of the control system of the printer 10.

As shown in FIG. 2, the printer 10 includes a computer constitution composed of a CPU (Central Processing Unit) 111, a ROM (Read Only Memory) 112 and a RAM (Random Access Memory) 113. The CPU 111 is a central processing device that collectively controls the printer 10. The ROM 112 stores various programs executed by the CPU 111 and control information. The RAM 113 functions as a working area of the CPU 111.

The printer 10 connects a non-volatile memory 114, a keyboard controller 115, a display controller 116, and the head driver 117 to the CPU 111. The printer 10 connects a keyboard 106 to the keyboard controller 115, a display device 107 to the display controller 116, as well as the thermal head 104 to the head driver 117, respectively.

The non-volatile memory 114 is a storage medium such as a flash memory and stores various setting information and various programs to be executed by the CPU 111. For example, the non-volatile memory 114 stores a gap voltage described later relating to positioning of a printing start position on the label paper PT (label L) as the setting information. The keyboard controller 115 outputs an operation signal in response to the operation on the keyboard 106 to the CPU 111. The display controller 116 displays various information on the display device 107 under the control of the CPU 111. Under the control of the CPU 111, the head driver 117 enables the thermal head 104 (heat generating element) to generate the heat.

The printer 10 connects the motor driver 118, a sensor control circuit 119 and a communication interface (I/F) 120 to the CPU 111. The printer 10 connects the stepping motor 102 to the motor driver 118 as well as the transmission type sensor 105 to the sensor control circuit 119. The printer 10 also connects the communication interface 120 to a network N such as an LAN (Local Area Network). For example, the printer 10 and other printers 10 of the same type as the printer 10 are connected to the network N.

The motor driver 118 drives the stepping motor 102 to rotate by outputting a drive pulse signal to the stepping motor 102 under the control of the CPU 111. The sensor control circuit 119 controls the operation of the transmission type sensor 105. Specifically, the sensor control circuit 119 operates the transmission type sensor 105 under the control of the CPU 111 to output a sensing result (output signal) of the transmission type sensor 105 to the CPU 111.

Figure 3:
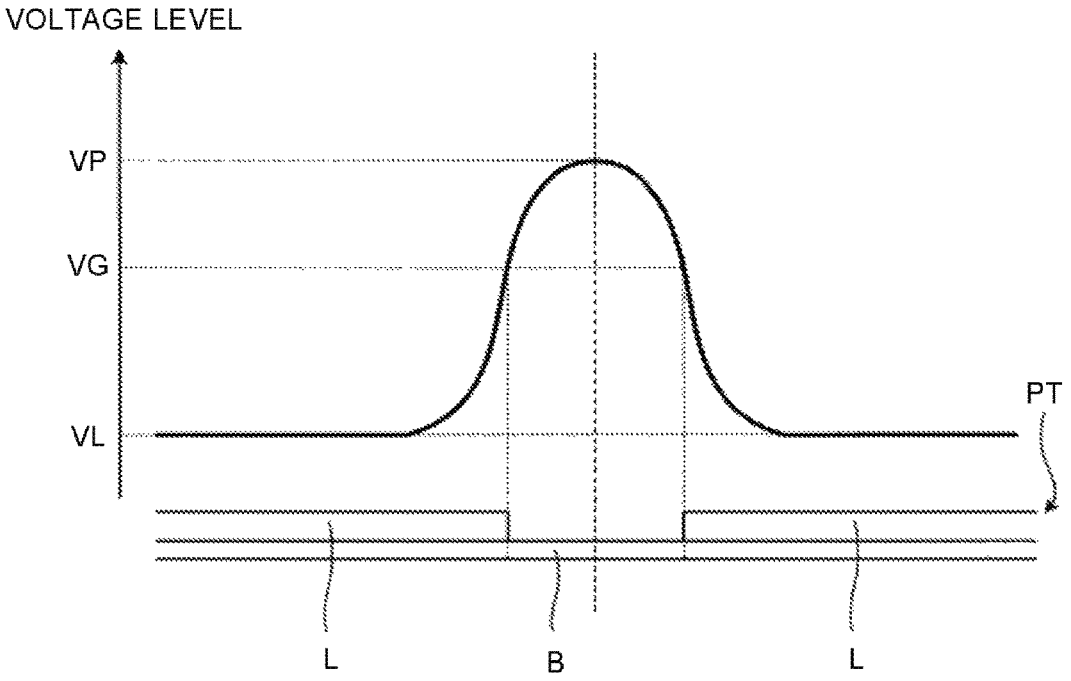
FIG. 3 is a diagram illustrating a relationship between a label paper and a waveform of an output signal of a transmission type sensor.

Herein, FIG. 3 is a diagram illustrating a relationship between the label paper PT and a waveform of the output signal of the transmission type sensor 105. As shown in FIG. 3, the label L is attached to a mount B at a predetermined interval in the label paper PT. The transmission type sensor 105 irradiates the label paper PT conveyed in the paper conveyance path with the light and detects the quantity of the light penetrating the label paper PT as a voltage level. At this time, the quantity of the light detected by the transmission type sensor 105 is increased at a portion where the label L is not attached, in other words, in the mount B portion (hereinafter, referred to as a gap part) between the labels L.

The CPU 111 detects a boundary position (hereinafter, referred to as a gap position) between the label L and the mount B based on the waveform of the output signal of the transmission type sensor 105. For example, the CPU 111 detects a voltage level of a peak position in the waveform of the output signal of the transmission type sensor 105 as a voltage level (hereinafter, referred to as a peak voltage VP) at a center position of the gap part. From the waveform of the output signal of the transmission type sensor 105, the CPU 111 detects a voltage level (hereinafter, referred to as a label voltage VL) of the portion to which the label L is attached. Herein, the label voltage VL corresponds to, for example, a voltage level of the lowest value and a voltage level of a position where the waveform becomes flat in the waveform of the output signal of the transmission type sensor 105.

Based on the detected peak voltage VP (or label voltage VL), the CPU 111 detects a voltage level obtained by decreasing (increasing) the detected voltage value by a predetermined amount as a voltage level (hereinafter, referred to as a gap voltage VG) corresponding to the gap position on the label paper PT. It is assumed that a change amount that causes the peak voltage VP (or the label voltage VL) to decrease (or increase) is determined in advance. The change amount can be preset according to, for example, a voltage difference between the peak voltage VP and the label voltage VL, the type of the paper and the like.

Further, the gap voltage VG detected as stated above is stored in the non-volatile memory 14 as the setting information. At the time of normal printing, the CPU 111 determines the printing start position of the label paper PT (label L) based on the gap voltage VG stored as the setting information.

Incidentally, the conventional printer is loaded with a function capable of manually correcting the printing start position. With the function, a user measures the printing start position in an exact size from an actual printing result and can carry out adjustment in such a manner that the printing start position becomes a proper position by inputting a correction value corresponding to a length of a deviation if the deviation occurs.

However, since it is necessary to measure the printing start position in the exact size, the above-described adjustment method is complicated, and there is a problem that time is required as the operation of inputting the correction value and checking the printing result is repeated in some cases.

Thus, the printer 10 of the present embodiment includes functional components for supporting an adjustment operation of the printing start position. Hereinafter, functional components which are included in the printer 10 and relate to the printing start position are described.

Figure 4:
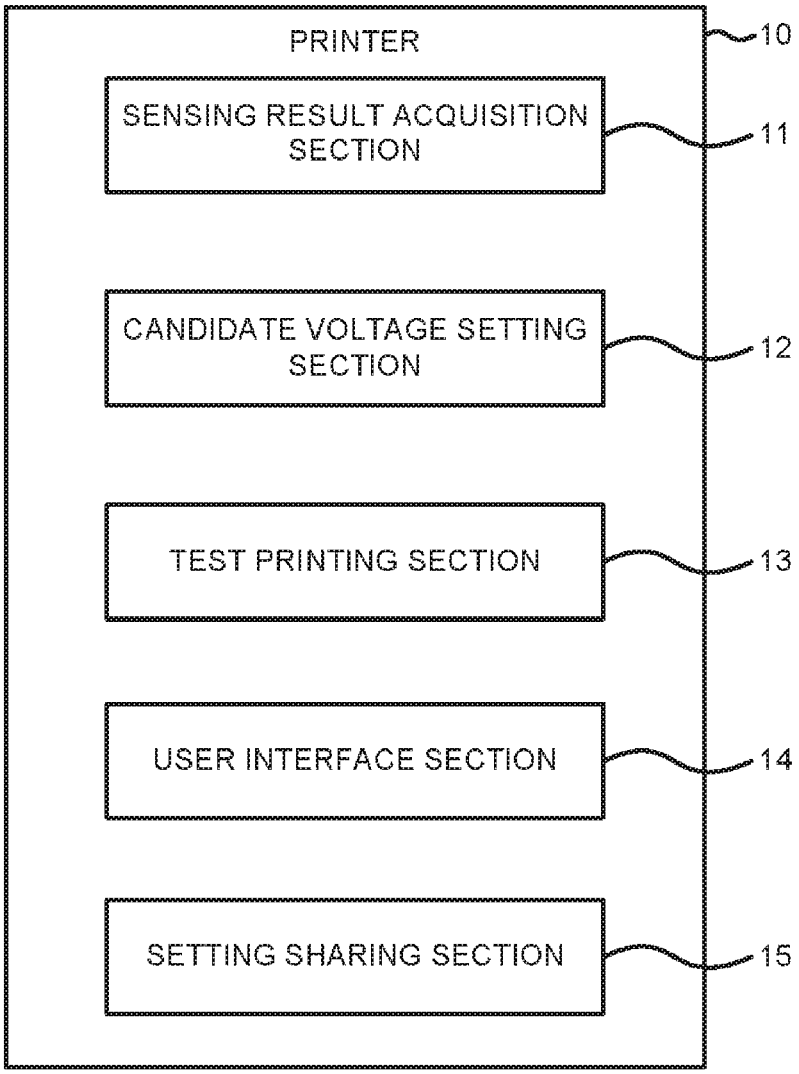
FIG. 4 is a diagram illustrating an example of functional components relating to adjustment of a printing start position included in the printer according to the embodiment.

FIG. 4 is a diagram illustrating an example of functional components relating to adjustment of the printing start position included in the printer 10. As shown in FIG. 4, the printer 10 includes a sensing result acquisition section 11, a candidate voltage setting section 12, a test printing section 13, a user interface section 14 and a setting sharing section 15 as functional sections. A part or all of those functional sections may be hardware constitution that is realized on the RAM 113 by cooperation of the CPU 111 and programs stored in the ROM 112 and the non-volatile memory 114. In addition, a part or all of those functional sections maybe hardware constitution that is realized by one or a plurality of processing circuits designed to realize each function.

The sensing result acquisition section 11 acquires the sensing result (waveform of the output signal) of the transmission type sensor 105 by cooperating with the sensor control circuit 119.

The candidate voltage setting section 12 corresponds to a first setting module of the present embodiment. The candidate voltage setting section 12 sets a plurality of voltage levels corresponding to a plurality of start candidate positions which are candidates of the printing start position as candidate voltages based on the sensing result acquired by the sensing result acquisition section 11.

Specifically, the candidate voltage setting section 12 sets a reference voltage which is a reference of the candidate voltages based on the sensing result acquired by the sensing result acquisition section 11. The reference voltage is not particularly limited as long as it is a value between the peak voltage and the label voltage obtained from the sensing result. For example, the reference voltage may be a voltage level (in other words, the gap voltage at the present stage) that is obtained by decreasing (or increasing) the peak voltage (or label voltage) detected from the sensing result by a predetermined amount. For example, the reference voltage may be an intermediate value between the peak voltage and the label voltage detected from the sensing result. The reference voltage may be contained in the candidate voltages or may not be contained in the candidate voltages.

The candidate voltage setting section 12 sets a plurality of candidate voltages by deviating the voltage value by a predetermined amount before and after the reference voltage. A deviation amount at the time of deviating the voltage value is not particularly limited and can use an optional value. For example, the deviation amount may be a certain voltage value (0.1V or the like). The deviation amount may be set so that the printing start position is deviated by a certain interval (0.5 mm or the like). Furthermore, the number of the candidate voltages set by the candidate voltage setting section 12 is not particularly limited. For example, it is preferable that the candidate voltages are not numerous, for example, two or three candidate voltages are set at a time before and after the reference voltage.

The test printing section 13 corresponds to a test printing module of the present embodiment. The test printing section 13 carries out a test printing for specifying the printing start positions (start candidate positions) corresponding to the candidate voltages set by the candidate voltage setting section 12 on the label paper PT by cooperating with the head driver 117 and the motor driver 118. Specifically, the test printing section 13 detects the candidate voltages (voltage levels) set by the candidate voltage setting section 12 from the sensing result acquired by the sensing result acquisition section 11. The test printing section 13 sets a position in the paper conveyance direction on the label paper PT corresponding to the detected voltage level as the gap position, and determines the printing start position on the label paper PT (label L) in the paper conveyance direction based on the gap position.

The test printing section 13 carries out the test printing for specifying the printing start position by operating the thermal head 104 if the thermal head 104 reaches the printing start position along with the conveyance of the label paper PT. Further, for the printing on the label L, if a margin setting for providing a margin part at the periphery of the label L is executed in advance, the test printing section 13 sets a position obtained by adding a length of the margin part in the conveyance direction to the gap position to the printing start position.

Figure 5:
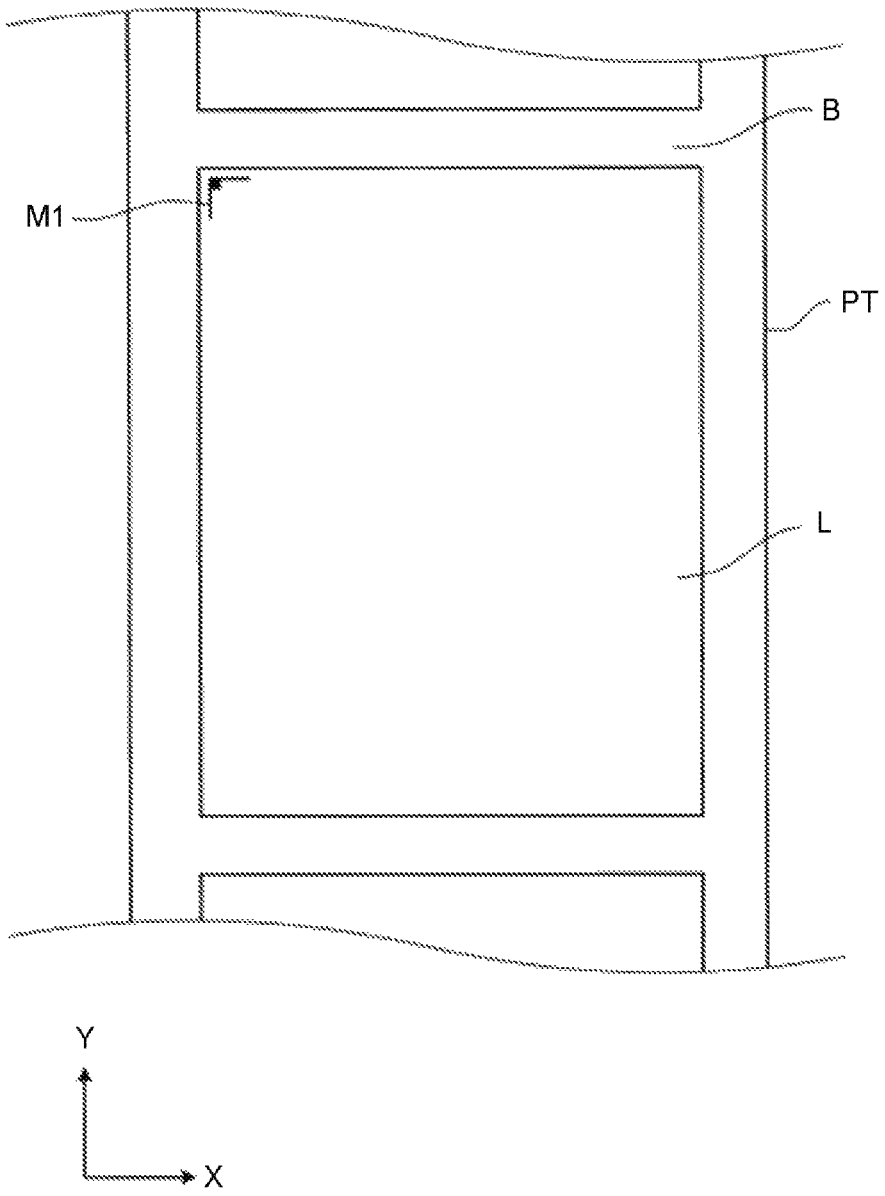
FIG. 5 is a diagram illustrating an example of a test printing result by a test printing section according to the embodiment.

FIG. 5 is a diagram illustrating an example of a test printing result by the test printing section 13. A mark M1 shown on the label paper PT (label L) is used to specify the printing start position. A corner of the mark M1 means the printing start positions in a main scanning direction X and a sub scanning direction (paper conveyance direction Y) on the label paper PT (label L).

In this way, the test printing section 13 carries out the test printing for specifying the printing start position corresponding to the candidate voltage on the label paper PT (label L) by using the candidate voltage set by the candidate voltage setting section 12. Thus, the user can easily confirm whether the printing start position is proper by confirming the printing start position that is test printed.

Furthermore, a shape and a size of the mark M1 printed on the label paper PT (label L) by the test printing are not limited to the example in FIG. 5; and the shape and the size of the mark M1 are particularly not limited as long as the mark M1 can specify the printing start position. For example, the mark M1 may indicate the printing start position with points (dots). The mark M1 may only indicate the printing start position in the paper conveyance direction Y.

The test printing section 13 may print information other than the mark M1. For example, the test printing section 13 may print a value and the correction amount of the candidate voltage used in the test printing. For example, if the margin setting for providing the margin part at the periphery of the label L, the test printing section 13 may print information indicating a size (length) of a margin part A1 in the paper conveyance direction at the margin part A1 as shown in FIG. 6.

Figure 6:
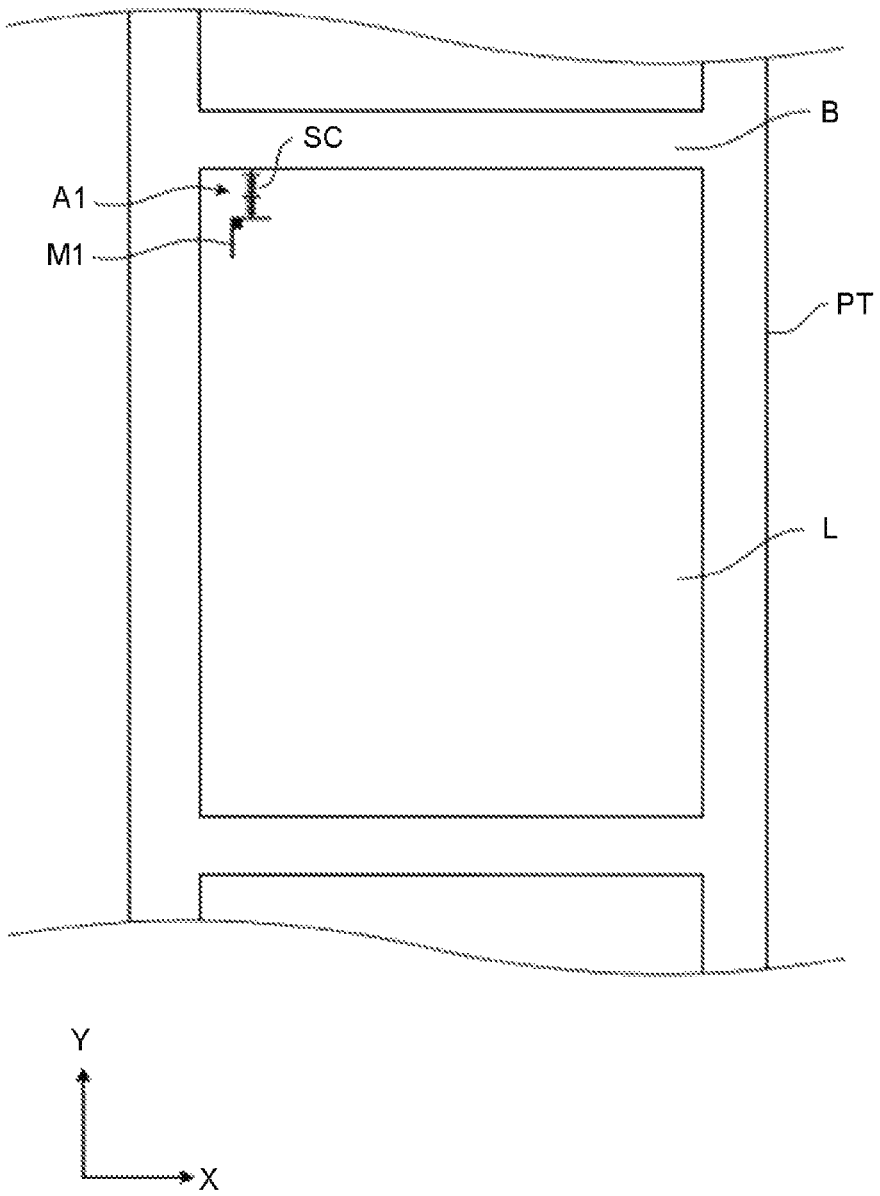
FIG. 6 is a diagram illustrating another example of the test printing result by the test printing section according to the embodiment.

FIG. 6 is a diagram illustrating another example of the test printing result by the test printing section 13. In FIG. 6, an example is shown in which a scale SC indicating the size (length) of the margin part A1 in the paper conveyance direction is printed at the margin part A1 of the label paper PT (label L).

In this way, the test printing section 13 prints the information indicating the size of the margin part A1 relating to the printing start position at the margin part A1 while specifying the printing start position on condition that the margin setting is executed. Thus, since the user can easily confirm whether the margin part A1 is correctly ensured, in other words, whether the printing start position on the label L is proper according to the scale SC printed at the margin part A1, the adjustment of the printing start position can be effectively executed.

The unit of a scale line is not particularly limited, for example, may be 0.1 mm or 1 mm. The unit of the scale line may be set according to a conveyance quantity of the label paper PT per step of the stepping motor 102 and a resolution degree (dpi) of the thermal head 104 (heat generating element).

By cooperating with the user interface section 14, the test printing section 13 receives a propriety instruction on the printing start position on the label paper PT. The test printing section 13 carries out the test printing by using the unused candidate voltage that is not used in the test printing on condition that it is instructed that the printing start position is not proper.

The user interface section 14 corresponds to a reception module and a second setting module according to the present embodiment. By cooperating with the keyboard controller 115 and the display controller 116, the user interface section 14 receives an operation from the user from the keyboard 106 and displays various operation screens and information on the display device 107. For example, by cooperating with the test printing section 13, the user interface section 14 displays a selection screen for urging to select one printing start position used in the normal printing from the printing start positions specified by the test printing on the display device 107.

Figure 7:
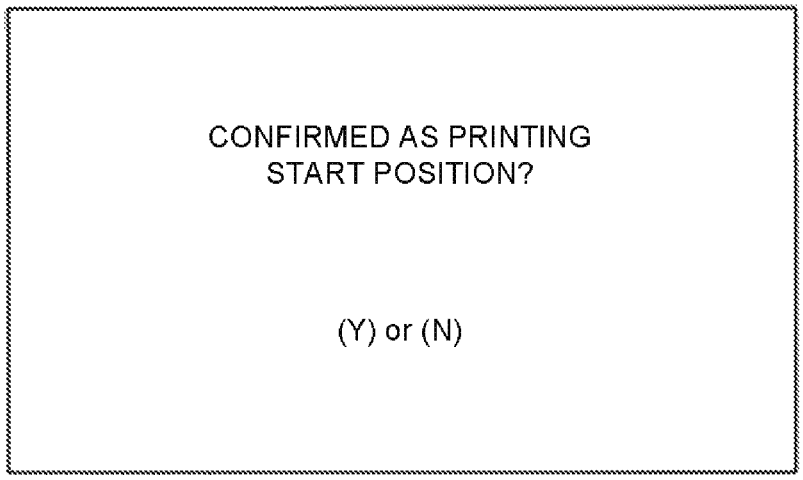
FIG. 7 is a diagram illustrating an example of a selection screen displayed on a user interface section according to the embodiment.

FIG. 7 is a diagram illustrating an example of the selection screen displayed on the user interface section 14. In the selection screen shown in FIG. 7, it is shown that the propriety on whether the printing start position specified by the test printing is used in the normal printing can be selected by operations on a "Y" button and an "N" button. The user interface section 14 receives an operation of the "Y" button or the "N" button via the keyboard 106 based on the selection screen.

If the operation on the "Y" button is received, the user interface section 14 determines that the confirmation of the printing start position is instructed. In this case, the user interface section 14 stores (sets) the candidate voltage used in the test printing by the test printing section 13 as the gap voltage used at the time of the normal printing in the setting information of the non-volatile memory 114.

Furthermore, the information stored in the setting information is not limited to the gap voltage, and other information may be stored (set). For example, the user interface section 14 may store the peak voltage and the label voltage detected from the sensing result at the time of setting the candidate voltage in the setting information together with the gap voltage. The user interface section 14 may store paper type information indicating the paper type (label paper PT) and the gap voltage in an associated manner in the setting information. In the present embodiment, it is assumed that the gap voltage is stored in the setting information together with the peak voltage and the label voltage.

If receiving the operation on the "N" button, the user interface section 14 determines that the printing start position specified by the test printing is rejected. In this case, the user interface section 14 outputs an instruction signal for instructing the rejection of the printing start position to the test printing section 13.

The test printing section 13 carries out the test printing by using one candidate voltage that is not used in the test printing among the candidate voltages set by the candidate voltage setting section 12 if the rejection of the printing start position from the user interface section 14 is instructed. In this way, the test printing section 13 carries out the test printing by sequentially using the candidate voltages set by the candidate voltage setting section 12 until the confirmation of the printing start position is instructed.

Further, the test printing section 13 notifies the user interface section 14 that the whole candidate voltages are used in a case of executing the test printing for the whole candidate voltages set by the candidate voltage setting section 12. The user interface section 14 determines that the rejection of the printing start positions for the whole candidate voltages that are set is instructed based on the notification from the test printing section 13. In this case, the user interface section 14 displays a correction value input screen through which the correction value for correcting the printing start position can be directly input on the display device 107 to receive the input of the correction value. The user interface section 14 stores the gap voltage corrected based on the correction value as the setting information in the non-volatile memory 114. The adjustment method using the correction value input screen is the same as that in the prior art described above, and thus the description thereof is omitted.

Return to FIG. 4, the setting sharing section 15 corresponds to a transmission module, the reception module and a third setting module of the present embodiment. The setting sharing section 15 carries out a processing for sharing the adjustment result of the printing start position among the printers 10.

Specifically, the setting sharing section 15 transmits the setting information (gap voltage, peak voltage (or label voltage)) stored in the non-volatile memory 114 by the user interface section 14 to other printers 10 via the communication interface 120. The setting sharing section 15 receives the setting information transmitted from other printers 10 via the communication interface 120. The setting sharing section 15 adjusts the gap voltage contained in the received setting information according to characteristics of the transmission type sensor 105 to reflect the gap voltage after adjusted in the setting information of the non-volatile memory 114.

The adjustment method of the gap voltage executed by the setting sharing section 15 is described. Since there is an individual difference in the transmission type sensors 105 generally in the plurality of the printers 10, even if the same label paper PT is used, the waveforms of the output signals obtained from the label paper PT are different. Thus, even if the gap voltage set by some printer 10 is set in other printers 10 without changes, there is a possibility that the printing start positions that are actually printed are different among the printers 10.

However, even if the characteristics of the transmission type sensor 105 are different, it is known that ratios of the gap voltage to the label voltage (or peak voltage) detected from the same label paper PT are in the same level. Based on the ratio of the gap voltage to the label voltage (or peak voltage) detected by other printers 10, by deriving (adjusting) the gap voltage from the label voltage (or peak voltage) detected by the printer 10, it is possible to reflect the adjustment results of other printers 10 to the printer 10.

For example, the label voltage and the gap voltage detected by other printers 10 are 2.0V and 4.0V. On the other hand, the label voltage and the gap voltage detected by the own printer 10 are 1.8V and 4.2V. In this case, if the gap voltage of other printers 10 is proper, by adjusting the gap voltage of 4.2V to 3.6V in the own printer 10 based on the ratio "1/2" of the gap voltage to the label voltage in other printers 10, it is possible to adjust the gap voltage to a proper value.

In this way, the setting sharing section 15 transmits and receives the setting information (gap voltage and the like) to and from other printers 10 to adjust the gap voltage of the own printer 10 based on the received setting information. In this way, for example, in a case in which the plurality of the printers 10 is connected with the network N, the printing start position set by one printer 10 can be reflected in printers 10, and thus, the adjustment of the printing start position can be effectively executed.

Further, the timing at which the setting sharing section 15 transmits the setting information to other printers 10 is not particularly limited. For example, at the time the user interface section 14 stores the gap voltage and the like as the setting information, the setting sharing section 15 may transmit the setting information to other printers 10. In this case, for example, the user interface section 14 may display a conformation screen for confirming whether or not the setting information is transmitted to other printers 10. The setting sharing section 15 transmits the setting information to other printers 10 on condition that the transmission of the setting information based on the confirmation screen is instructed by the user.

The user interface section 14 may display a confirmation screen for confirming whether or not the setting information is reflected in the own printer 10 in a case in which the setting information is received from other printers 10. The setting sharing section 15 adjusts the gap voltage of the own printer 10 based on the received setting information on condition that the reflection of the setting information based on the confirmation screen is instructed by the user.

In the present embodiment, the setting sharing section 15 transmits the gap voltage and the label voltage (or peak voltage) as the setting information; however, the present invention is not limited to that. For example, the ratio of the gap voltage to the label voltage (or peak voltage) may be transmitted as the setting information.

The network constitution of the printer 10 relating to the transmission and the reception of the setting information is not particularly limited. For example, the whole printer 10 may be a P2P type constitution for carrying out transmission and reception of the setting information. The network constitution may be a master slave type constitution for transmitting the setting information to other printers 10 operating as slaves from one printer 10 operating as a master.

Figure 8:
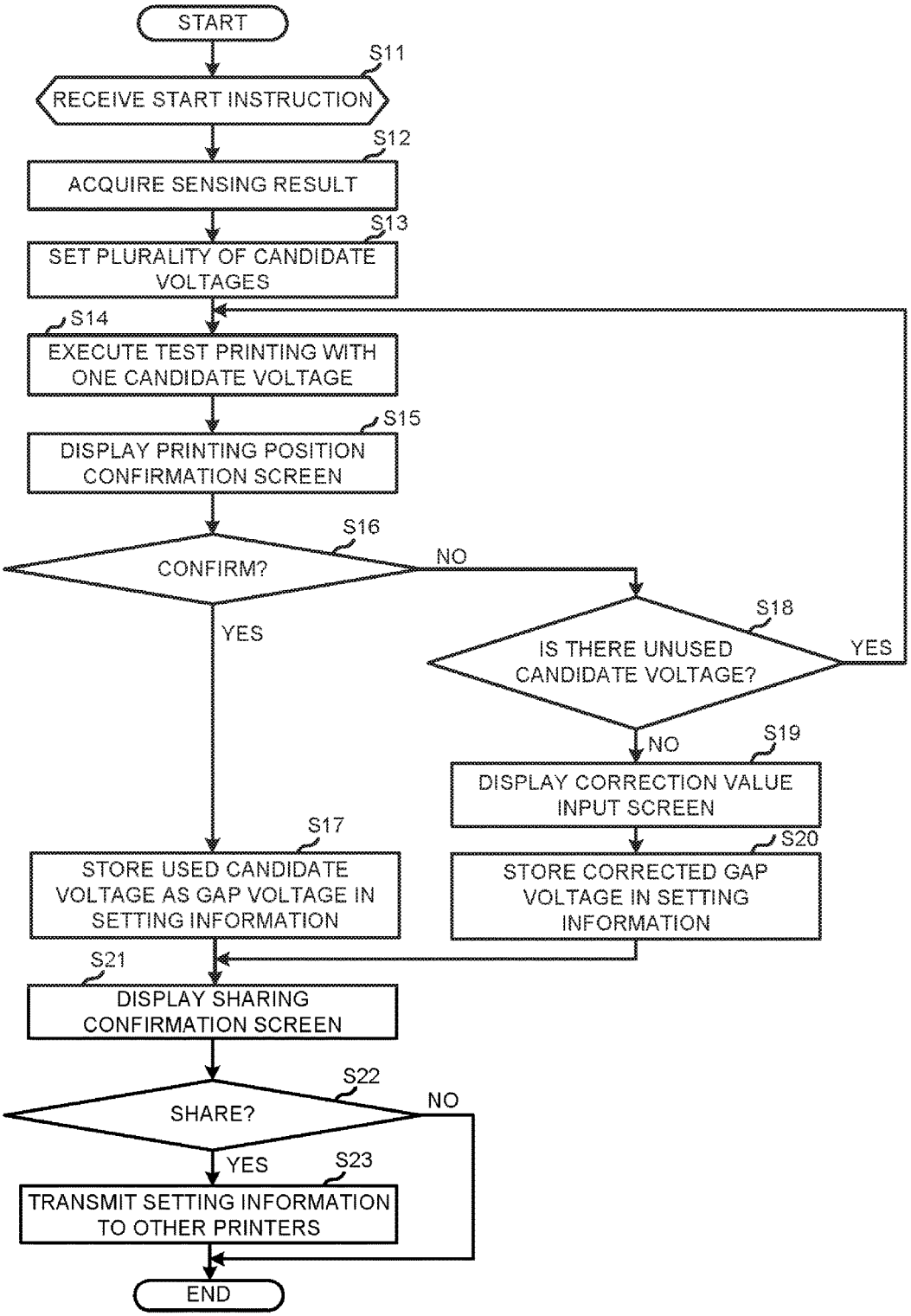
FIG. 8 is a flowchart illustrating an example of a printing start position adjustment processing executed by the printer according to the embodiment.

The operation of the printer 10 relating to the adjustment of the printing start position is described with reference to FIG. 8. FIG. 8 is a flowchart illustrating an example of a printing start position adjustment processing executed by the printer 10.

The CPU 111 starts the present processing if receiving an instruction for starting the adjustment of the printing start position via the keyboard 106 and the like (Act S11). Along with the start of the present processing, since the sensing result of the transmission type sensor 105 is obtained, the CPU 111 conveys the label paper PT by a predetermined amount by cooperating with the motor driver 118.

The sensing result acquisition section 11 acquires the sensing result of the label paper PT detected by the transmission type sensor 105 along with the conveyance of the label paper PT (Act S12). Based on the sensing result obtained in Act S12, the candidate voltage setting section 12 sets a plurality of candidate voltages (Act S13).

The test printing section 13 carries out the test printing by using one candidate voltage set in Act S13 by cooperating with the head driver 117 and the motor driver 118 (Act S14). The user interface section 14 displays the selection screen for urging to select the propriety of the printing start position specified by the test printing in Act S14 on the display device 107 (Act S15). The user interface section 14 determines whether or not the confirmation of the printing start position is instructed based on the selection screen displayed in Act S15 (Act S16).

If the confirmation of the printing start position is instructed (Yes in Act S16), the user interface section 14 stores the candidate voltage used in the test printing in Act S14 to store the candidate voltage as the gap voltage in the setting information (Act S17), and then proceeds to the processing in Act S21. Further, the user interface section 14 also stores the information (label voltage, peak voltage, etc.) other than the gap voltage in Act S17.

On the other hand, if the rejection of the printing start position is instructed (No in Act S16), the test printing section 13 determines whether or not there is the candidate voltage that is not used in the test printing (Act S18). If there are unused candidate voltages (Yes in Act S18), the test printing section 13 returns to the processing in Act S14 to carry out the test printing by using one of the unused candidate voltages.

In Act S18, if all the candidate voltages are used in the test printing (No in Act S18), the user interface section 14 displays the correction value input screen for receiving the direct input of the correction value (Act S19). The user interface section 14 stores the gap voltage and the like corrected based on the input correction value as the setting information (Act S20), and then proceeds to the processing in Act S21. Further, the test printing section 13 may carry out the test printing based on the correction value input in Act S19.

In Act S21, the user interface section 14 displays a sharing confirmation screen for confirming whether or not the setting information stored in Act S17 or Act S20 is shared with other printers 10 (Act S21). The setting sharing section 15 determines whether or not the sharing of the setting information is instructed based on the sharing confirmation screen (Act S22).

If the sharing of the setting information is instructed (YES in Act S22), the setting sharing section 15 transmits the setting information stored in Act S17 or Act S20 to other printers 10 (Act S23), and then terminates the present processing. If the non-sharing of the setting information is instructed (No in Act S22), the setting sharing section 15 immediately terminates the present processing without transmitting the setting information.

As stated above, the printer 10 sets the plurality of the candidate voltages which are candidates of the printing start position to carry out the test printing for specifying the printing start positions (start candidate positions) corresponding to those candidate voltages on the label paper PT (label L). The printer 10 stores the candidate voltage corresponding to one printing start position selected by the user from the printing start positions specified by the test printing as the gap voltage in the setting information.

In this way, the use selects one printing start position determined to be proper from the printing start positions specified by the test printing to be capable of completing the adjustment of the printing start position, and thus, it is possible to effectively carry out the adjustment of the printing start position. In a case in which the margin setting is executed, since the user can grasp the size of the margin part with the scale printed at the margin part, the use can easily confirm whether the printing start position is proper.

In the present embodiment, the test printing is individually executed for each candidate voltage set by the candidate voltage setting section 12; however, the present invention is not limited to this. The test printing of the plurality of candidate voltages may be executed on the same label L once. In this case, the test printing section 13 carries out the test printing as shown FIG. 9 by using the plurality of the candidate voltages set by in the candidate voltage setting section 12 once.

Figure 9:
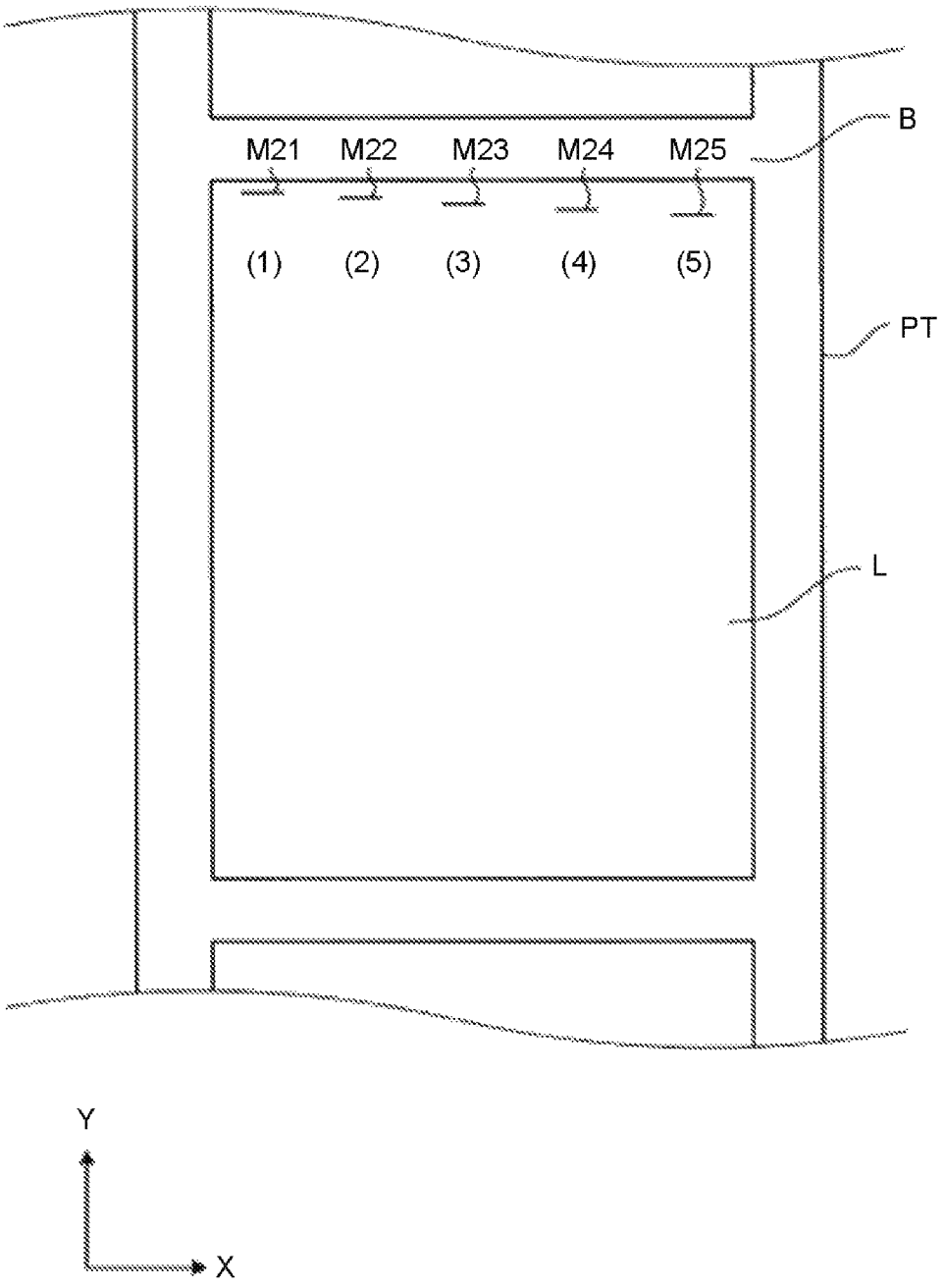
FIG. 9 is a diagram illustrating the other example of the test printing result by the test printing section according to the embodiment.

FIG. 9 is a diagram illustrating the other example of the test printing result by the test printing section 13. In FIG. 9, markers M21~M25 indicate the printing start positions in the paper conveyance direction Y on the label L (label paper PT). The markers M21~M25 are printed based on different candidate voltages, and thus the printing start positions are mutually different. The test printing section 13 prints identification numbers (1~5) for identifying the markers in association with the marks M21~M25.

On the other hand, the user interface section 14 displays the selection screen shown in FIG. 10 along with the test printing in FIG. 9. FIG. 10 is a diagram illustrating another example of the selection screen displayed on the user interface section 14. In the selection screen, that one printing start position used in the normal printing is selected by the input of the identification number from the printing start positions of the markers M21~M25 that are test printed. The user of the printer 10 inputs the identification number of the marker of the printing start position that is determined to be proper from the keyboard 106 based on the selection screen.

If receiving the input of the identification number via the keyboard 106, the user interface section 14 stores the candidate voltage used in the printing of the marker corresponding to the identification number to as the gap voltage in the setting information of the non-volatile memory 114. The printer 10 carries out printing on the label paper PT (label L) based on the gap voltage stored as the setting information in the following printing. If the "N" button instructing a manual adjustment is selected, the user interface section 14 displays the correction value input screen capable of directly inputting the correction value.

In this way, since the use can select one printing start position while comparing the plurality of the printing start positions that is test printed, the convenience of the user relating to the selection of the printing start position can be further improved. The number of the labels L used in the test printing can be suppressed.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

For example, in the foregoing embodiment, the label printer is described as an example; however, the type of the printer is not limited to that. In the foregoing embodiment, a thermal printer for carrying out printing on a thermal paper with the thermal head 104 is described as an example; however, the printing method is not limited to that.

In the foraging embodiment, based on the sensing result of the transmission type sensor 105, an example in which the printing start position on the label paper PT is adjusted is described; however, the adjustment method of the forgoing embodiment can also be applied to other types of sensors or other types of papers. For example, there are a paper (For example, continuous paper, tag paper, etc.) on which a mark (hereinafter, referred to as a mark for position detection) for position detection called a black mark or a timing mark is printed. In the printer which performs printing on such a paper, the mark for position detection is detected using a reflection type sensor installed in the paper conveyance path to set the printing start position in the paper conveyance direction based on the detection result. Even if the reflection type the sensor is used, since the adjustment operation of the printing start position occurs, the adjustment method of the above embodiment can also be applied to the printer using the reflection type sensor in the position detection.

The waveform of the output signal of a mark part for position detection and a mark part for non-position detection detected by the reflection type sensor are opposite to the waveform of the output signal of the transmission type sensor 105 described above. Therefore, by inverting the top and bottom of the output signal of the reflection type sensor, the waveform of the output signal detected by the reflection type sensor can be handled in the same way as the sensing result of the transmission type sensor 105.

The program executed by the printer 10 in the above embodiment is a file of an installable form or an executable form and may be recorded in a computer-readable recording medium such as a floppy® Technology disk, a CD (Compact Disc), a CD-R (Compact Disc-Recordable), a CD-ROM (Compact Disc Read Only Memory), a DVD (Digital Versatile Disc), an SD memory card (SD memory card), a USB memory (Universal Serial Bus memory) and the like to be provided.

The program executed by the printer 10 in the above embodiment may be stored in a computer connected to a network such as an internet and provided by being downloaded via the network.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A printer, comprising:

a sensor configured to irradiate a label paper with light and detect a quantity of light penetrating the label paper as a voltage level, the label paper being attached to a mount of labels at a predetermined interval;

a candidate setting module configured to set a plurality of candidate voltage between the peak voltage and the lowest voltage obtained from the sensing result acquired by the sensor; and a test printing module configured to detect the candidate voltage set by the candidate setting module from the sensing result acquired by the sensor, set a position in the label conveyance direction on the label paper corresponding to the detected candidate voltage, determine a start candidate position on the label in the label paper conveyance direction based on the detected position, and carry out a test printing for specifying the start candidate position on the label.

2. The printer according to claim 1, wherein the test printing module individually executes the test printing for each start candidate position corresponding to the plurality of candidate voltages.

3. The printer according to claim 1, wherein the test printing module carries out the test printing of the plurality of the start candidate positions corresponding to the plurality of candidate voltages on the same paper.

4. The printer according to claim 1, wherein the test printing module prints a scale indicating a size of a margin part at the margin part relating to the start candidate position as the test printing when the margin part is arranged at the periphery of the paper.

5. The printer according to claim 1, wherein the sensor comprises a light emitting element and a light receiving element.

6. The printer according to claim 1, wherein the paper comprises a label paper in a roll shape.

7. The printer according to claim 1, wherein the sensor irradiates the paper with light and detects a quantity of light penetrating the paper as a voltage level.

8. The printer according to claim 7, wherein the test printing module specifies each start candidate position with a corner mark or a dot.

* * * * *